United States Patent [19]

Margaria

[11] Patent Number: 4,905,447

[45] Date of Patent: Mar. 6, 1990

[54] CLOSURE APPLYING APPARATUS

[75] Inventor: Mario Margaria, San Damiano D'Asti, Italy

[73] Assignee: Alplast S.p.A., Asti, Italy

[21] Appl. No.: 283,448

[22] PCT Filed: Feb. 23, 1987

[86] PCT No.: PCT/EP87/00099

§ 371 Date: Nov. 18, 1988

§ 102(e) Date: Nov. 18, 1988

[87] PCT Pub. No.: WO87/07588

PCT Pub. Date: Dec. 17, 1987

[30] Foreign Application Priority Data

Jun. 4, 1986 [IT] Italy ..... 67462 A/86

[51] Int. Cl.[4] ..... B67B 3/20; B67B 3/22; B65B 7/28

[52] U.S. Cl. ..... 53/317; 53/331.5

[58] Field of Search ..... 53/317, 331.5, 306, 53/329

[56] References Cited

U.S. PATENT DOCUMENTS

| | | | |
|---|---|---|---|
| 2,819,577 | 1/1958 | Dimond | 53/317 |
| 3,031,822 | 5/1962 | Dimond . | |
| 4,178,733 | 12/1979 | Dankert | 53/331.5 |
| 4,249,362 | 2/1981 | Brownbill | 53/331.5 X |
| 4,674,263 | 6/1987 | Kelly | 53/331.5 X |
| 4,696,144 | 9/1987 | Bankuty et al. | 53/331.5 |

FOREIGN PATENT DOCUMENTS

| | | |
|---|---|---|
| 0103567 | 3/1984 | European Pat. Off. . |
| 2420505 | 10/1979 | France . |

*Primary Examiner*—Horace M. Culver

*Attorney, Agent, or Firm*—Sughrue, Mion, Zinn, Macpeak & Seas

[57] ABSTRACT

A closure applying apparatus (1) suitable for use in capping machines for placing, on a container (B) having a threaded neck portion (26) and an annular collar (30) below said neck portion, a tamper-evident screw-type capsule (A) made of rigid plastic material and having a lower skirt portion (27) which is connected by a plurality of thin frangible bridge portions (28) to an upper internally threaded skirt portion (22) and is provided with an inwardly projecting bead (29) for snap engaging beneath said annular collar (30) as a result of screwing of the capsule (a) on the container (B). The apparatus comprises a rotary, vertically reciprocable capping chuck having a plurality of jaws (4) for gripping the capsule (A), each jaw (4) being provided at its lower end with an inner flange (14) which engages from below the edge of the lower skirt portion (27). The flange (14) of the jaws (4) form an abutment surface for the lower skirt portion (27), which absorbs the forces produced during snap movement of the inwardly projecting head (29) over the collar (30) of the container (B), thus preventing fracture of the bridges (28) during the capping operation.

1 Claim, 3 Drawing Sheets

CLOSURE APPLYING APPARATUS

The present invention relates to a closure applying apparatus suitable for use in capping machines for placing on a container having a threaded neck portion and an annular collar below said neck portion a one-piece tamper-evident screw-type capsule made of rigid plastic material, said capsule including a horizontal end wall and a longitudinal side wall which comprises an upper internally threaded skirt portion, a lower skirt portion which is provided with an inwardly projecting bead for snap engaging beneath said annular collar as a result of screwing of the capsule on the container and a plurality of thin frangible bridge portions connecting said upper and lower skirt portions.

Said capsules are useful in various applications, including soda bottles and containers which are maintained under significant pressure.

Unscrewing of said capsules after the capping operation provides visible evidence that the container between opened due to fracture of the bridges and separation of the lower skirt portion from the capsule.

U.S. Pat. No. 3,031,822 describes a closure applying apparatus for use in capping machines for placing screw-type caps on containers, which comprises a rotary, vertically reciprocable capping chuck having a plurality of jaws for gripping the cap, each jaw being pivotally movable between an open and a closed position and including an inwardly extending projection which, in the jawclosed position, rests on the top of the cap and an arcuate portion which engages the cylindrical side wall of the cap.

Said apparatus could not be used for applying a tamper-evident capsule of the above mentioned type to a container, because such a use would imply a very high risk of fracture of the bridges during the capping operation.

As a matter of fact, when during the capping operation, the lower surface of the bead on the lower skirt portion of the capsule comes into contact with the collar of the container, the thin bridges collapse and the upper and lower skirt portions of the capsule come into contact with each other. The lower skirt portion is therefore subjected to a compressive stress before the bead snaps beneath the container collar. During said snap movement the sudden release of said compression stress in the lower skirt portion would cause an elongation of the bridges beyond their original length and a fracture of said bridges due to tensile stress would thereby occur.

The invention as claimed is intended to remove this drawback.

The advantages offered by the invention are that the inner flanges of the jaws of the capping chuck form an abutment surface of the lower skirt portion, which absorbs the forces produced during movement of the inwardly projecting bead over the collar of the container, thus preventing fracture of the bridges during the capping operation.

One way of carrying out the invention is described in detail below with reference to the annexed drawings which illustrate in detail only one specific embodiment, in which.

Figure 1:
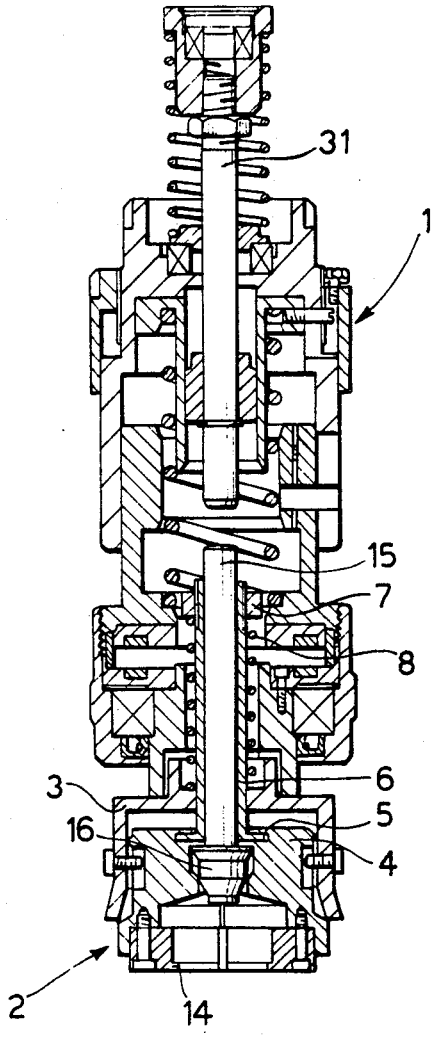
FIG. 1 is a vertical sectional view of a closure applying apparatus according to the invention.

In the drawings, a closure applying apparatus which is suitable for use in capping machines for placing screw-type capsules onto containers is generally indicated 1.

The upper part of the apparatus is of conventional type whereby only the lower part, which includes a rotary, vertically reciprocable capping chuck 2, will be described in detail.

Chuck 2 comprises a bell-shaped driving member 3 and a plurality of jaws 4 having recesses 4a at the upper ends of their inner surfaces, in which the flange 5 of a tubular element 6 slidable centrally within the bell 3 is engaged with play.

To the upper end of the tubular element 6 is screwed a ring 7 against which bears a helical spring 8 which acts against the bell 3 at its other end.

The upper external part of each jaw 4 has a toroidal bead 9 which bears against the inner surface of the bell 3.

The central part of each jaw 4 has a recess 10 in which a drive pin 11 screwed into the bell 3 is engaged.

To the inner lower end of each jaw 4 is connected by screws 13 a part 12 having a plurality of vertical serrations **12*a* and a radially-inwardly-projecting flange 14** at its lower end.

A rod 15 is slidable in the tubular element 6 and, at its lower end, has an enlarged foot **15*a* with a cylindrical part 16, a conical part 17, and a cylindrical end part 18**.

In correspondence with the foot **15*a*, the inner surface of each jaw 4 has a tooth-shaped projection 44 with a conical upper surface 19, a conical side surface 20 and a flat lower surface 4*b*, having a distance from the flange 14** which substantially corresponds to the height of the capsules to be places on a container.

Figure 2:
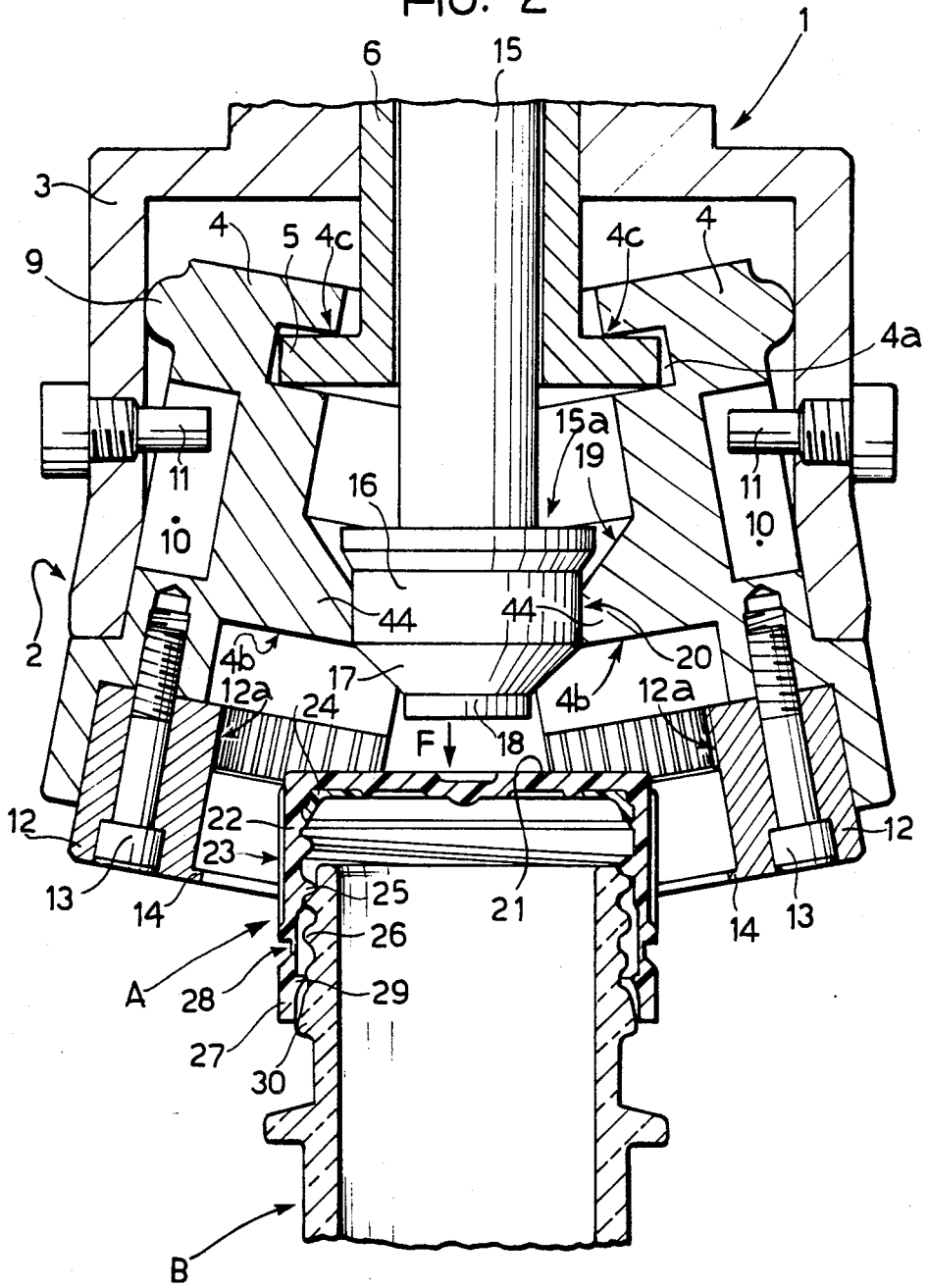
FIG. 2 is an enlarged vertical sectional view of the capping chuck of the apparatus illustrated in fig. 1, the chuck being shown in its open position before it closes on a tamper-evident capsule resting on the mouth of a container.

In the open position of the chuck 2 illustrated in FIG. 2, the cylindrical surface 16 of the foot **15*a* of rod 15 engages the conical surface 20 of each jaw, which thus assumes an inclined position with its fulcrum of rotation 4*c* resting on the flange 5 of the tubular element 6**.

The chuck illustrated in FIG. 2 is moving downwardly in the direction indicated by the arrow F towards a capsule, generally indicated A, resting on the mouth of a container B.

The capsule A is a one-piece tamper-evident screw-type capsule made from a rigid plastics material, such as polypropylene with a suitable filler, and is suitable for various applications, including soda bottles and containers which are maintained under significant pressure.

The capsule A comprises a horizontal end wall 21 and an upper skirt portion 22 having a plurality of vertical serrations 23.

The inner surface of wall 21 is provided with a sealing ring 24 constituted by a plastic mastic.

The upper skirt portion 22 has internal threading 25 for engaging the external threading 26 of the neck of container B.

The capsule A has a lower integral skirt portion 27 connected to the upper skirt portion 22 by a plurality of thin frangible bridge portions 28.

The lower skirt portion 27 has an inwardly projecting bead 29 for snap-engaging beneath an annular collar 30 carried by the neck of the container B below the threaded portion 26.

The internal diameter of the annular projection 29 is greater than the outer diameter of the threading 26 of the container B whereby the lower end of the capsule threading 25 rests on the upper end of the container threading 26 in the position illustrated in FIG. 2, that is before the capping operation is started.

The descent of the chuck 2 from the position shown in FIG. 2 brings the cylindrical part 18 of the foot 15*a* of rod 15 into contact with the horizontal end wall 21 of the capsule so that the further descent of the chuck causes relative axial movement between the jaws 4 of the chuck and the foot 15*a*.

Figure 3:
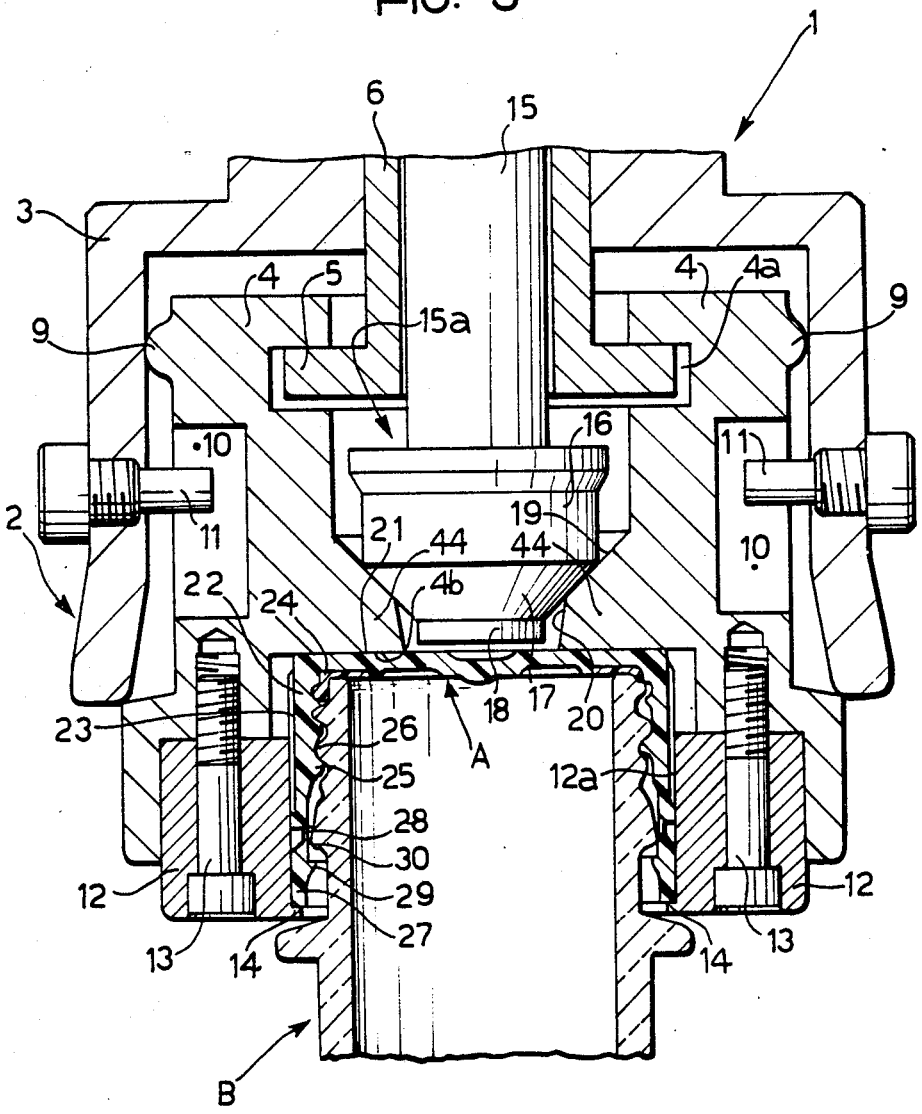
FIG. 3 is a view similar to FIG. 2, the chuck being shown in its closed position at the end of the capping operation.

As a result of this relative displacement, the cylindrical part 16 is disengaged from the conical part 20 and the conical part 17 is brought into contact with the conical part 19, as illustrated in FIG. 3, thus allowing the jaws 4 to close on the capsule A.

In this closed position, the flat lower surfaces 4*b* of the haws 4 engage the horizontal end wall 21 of the capsule A, the serrations 12*a* engage the serrations 23 of the upper skirt portion of the capsule to rotate it, and the flanges 14 of the jaws 4 engage from below the lower edge of the lower skirt portion 27.

As the capsule A gripped by the chuck 2 is threaded onto the container B, the lower surface of the bead 29 on the lower skirt portion 27 comes into contact with the collar 30 of the container, the thin bridges 28 collapse and the upper and lower skirt portions 22, 27 come into contact with each other. The lower skirt portion 27 is therefore subjected to a compressive stress before the bead 29 snaps over the container collar 30.

The snap downward movement of the lower skirt portion 27 with respect to the upper skirt portion 22 caused by the sudden release of said compressive stress is limited by the flanges 14 of the jaws 4, which form an abutment for the lower edge of the lower skirt portion 27.

Therefore, the thin bridges 28 connecting the two skirt portions 22, 27 of the capsule cannot be stretched beyond their original lenght, thus preventing fracture of said bridges during the capping operation.

At the end of the capping operation, that is in the position illustrated in FIG. 3, a rod 31 of the apparatus illustrated in FIG. 1 descends and lowers the rod 15, the foot 15*a* of which is brought into the position illustrated in FIG. 2, causing the jaws 4 to open.

I claim:

1. Closure applying apparatus suitable for use in capping machines for placing on a container having a threaded neck portion and an annular collar below said neck portion a one-piece tamper-evident screw-type capsule made of rigid plastic material, said capsule including a horizontal end wall and a cylindrical side wall which comprises an upper internally threaded skirt portion, a lower skirt portion which is provided with an inwardly projecting bead for snap engaging beneath said annular collar as a result of screwing of the capsule on the container and a plurality of thin frangible bridges connecting said upper and lower skirt portions, said apparatus comprising a rotary, vertically reciprocable capping chuck having a plurality of jaws for gripping the upper skirt portion of the capsule, each jaw being pivotally movable between an open and closed position and including an inwardly extending projection which, in the jaw-closed position, rests on the top of the capsule and an arcuate portion which engages the upper skirt portion of the capsule, characterised in that each jaw (4) of the chuck (2) is provided at its lower end with an inner flange (14), the distance between said inner flanges (14) and said inwardly extending projection (44) substantially corresponding to the height of the capsule (A), whereby each of said flanges (14) forms an axial abutment surface which engages from below the edge of the lower skirt portion (27), thus preventing fracture of the bridges (28) due to axial stretching beyond their original length during the capping operation.

* * * * *